United States Patent [19]

Wilson et al.

[11] 4,026,221

[45] May 31, 1977

[54] MULTI-LEG MOBILE FOLDING STAGE

[75] Inventors: Kermit H. Wilson, Edina; Richard C. Bue, Chaska; Ronald R. Carlson, Mound, all of Minn.

[73] Assignee: Sico Incorporated, Minneapolis, Minn.

[22] Filed: Oct. 29, 1975

[21] Appl. No.: 626,979

[52] U.S. Cl. ..... 108/113; 108/19; 108/37

[51] Int. Cl.[2] ..... A47B 85/00

[58] Field of Search ..... 108/2, 37, 112, 113, 108/19; 5/164 D

[56] References Cited

UNITED STATES PATENTS

| | | | |
|---|---|---|---|
| 2,730,417 | 1/1956 | Mitchell | 108/113 |
| 3,861,325 | 1/1975 | Bue et al. | 108/113 X |
| 3,903,812 | 9/1975 | Cowley | 108/2 |

FOREIGN PATENTS OR APPLICATIONS

| | | | |
|---|---|---|---|
| 1,041,643 | 10/1958 | Germany | 108/19 |

*Primary Examiner*—James C. Mitchell
*Attorney, Agent, or Firm*—Merchant, Gould, Smith, Edell, Welter & Schmidt

[57] ABSTRACT

An elevationally adjustable mobile folding stage includes two independent stage members pivotally connected for movement between an operational position and a folded storage position. Support legs are pivotally mounted to the two stage members and are pivotally connected to cross brace linkage means which interconnect the support legs and the stage members for automatically folding the legs when the stage members are pivoted to their folded position. The legs of the stage are elevationally adjustable and include roller wheels for mobility of the stage when in its folded position. A counter balance spring system is provided to assist in folding the stage.

1 Claim, 8 Drawing Figures

MULTI-LEG MOBILE FOLDING STAGE

BACKGROUND OF THE INVENTION

The present invention relates generally to stages and the like, and more particularly to an elevationally adjustable folding stage. This invention is in the nature of an improvement on portable or folding stages of the type disclosed in U.S. Pat. No. 2,978,754 issued to Kermit H. Wilson on Apr. 11, 1961, U.S. Pat. No. 3,351,029 issued to Richard C. Bue on Nov. 7, 1967, and U.S. Pat. No. 3,276,401, issued to K. H. Wilson, et al, on Oct. 4, 1966.

Folding and portable stages and the like have been popular in schools, churches, hotels, and the like, where the use requirements of any given room vary considerbly such that installing a permanent stage structures would be unnecessary or impractical. In these situations, it is very desirable to have portable stages which can be easily set up for use, and thereafter conveniently folded and stored.

The same flexibility of room use requirements that make folding portable stages convenient often require elevational adjustment of stages, in order to accommodate different uses. The present invention accordingly provides an elevational adjustment feature in a portable, mobile folding stage. In so doing, the present invention provides a maximum of flexibility, but with a minimum of additional parts or assembly. The resulting structure is versatile, durable, compact in its folded position, and convenient and simple in use and adjustment.

SUMMARY OF THE INVENTION

To provide these features and advantages, the present invention provides a portable folding stage which includes first and second stage members having generally planar stage surfaces, and means for pivotally interconnecting them. First and second pairs of legs are pivotally connected to the first and second stage members, respectively, and are adapted for movement between an operational position wherein the leg extends to support the stage in a generally horizontal position above the surface, and a folded position wherein the legs fold to a position substantially parallel to the surfaces of the stage members. Pairs of cross brace linkage bars are pivotally connected to the undersides of the stage members and extend to pivotally connect to the leg on the opposite stage member, such that the cross brace linkages cause the legs to move to their folded position when the stage members are moved to their folded position. In the folded position, the stage is still supported by the legs which extend beneath the lowest edges of the folded stage. In a preferred embodiment, wheels are provided on the legs and mounted for ground engagement in the folded position so that the folded stage may readily be moved. Counter balance spring systems, which in the preferred embodiment comprise spring tensioned cables wrapped around cam surfaces, apply a bias force to assist in raising the stage to its folded position. Means are provided for elevationally adjusting the stage when in its operational position. In a preferred embodiment, such means comprise auxiliary legs pivotally adjustable to a ground engaging position, and telescopically adjustable to a desired height.

DETAILED DESCRIPTION OF THE DRAWINGS

Figure 2:
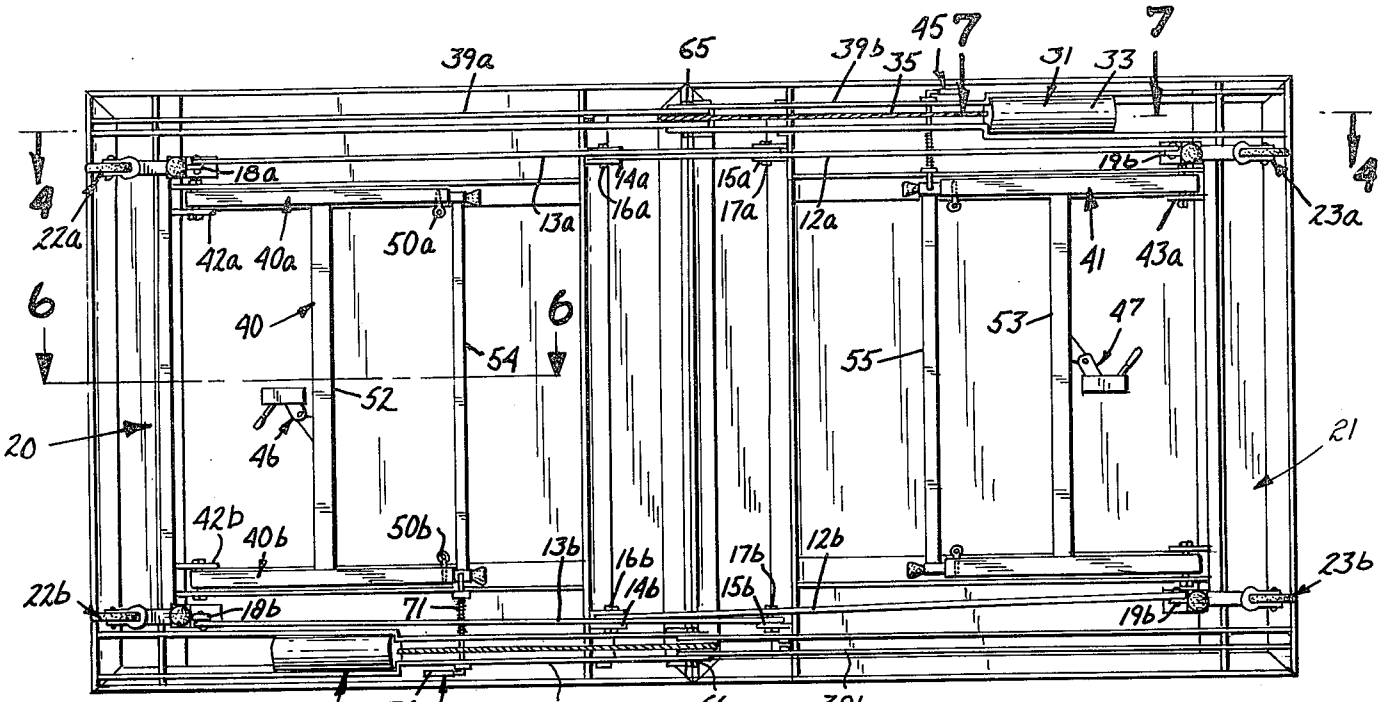
FIG. 2 is a view in bottom plan of the stage of FIG. 1.

In the foregoing description, in which like numerals indicate like parts, the stage of the present invention is generally defined by a first stage member 10 and a second stage member 11. As shown in FIG. 2, the first stage member 10 is a generally rectangular stucture having a generally planar surface. The second stage member 11 is substantially identical to the first stage member 10. The individual stage members 10 and 11 can be made of any suitable material such as wood, aluminum, or steel, and the surfaces of stage member 10 and stage member 11 can be finished or rough surfaces depending upon use requirements. Further, stage members 10 and 11 can be reinforced along the undersides thereof for additional strength.

Figure 1:
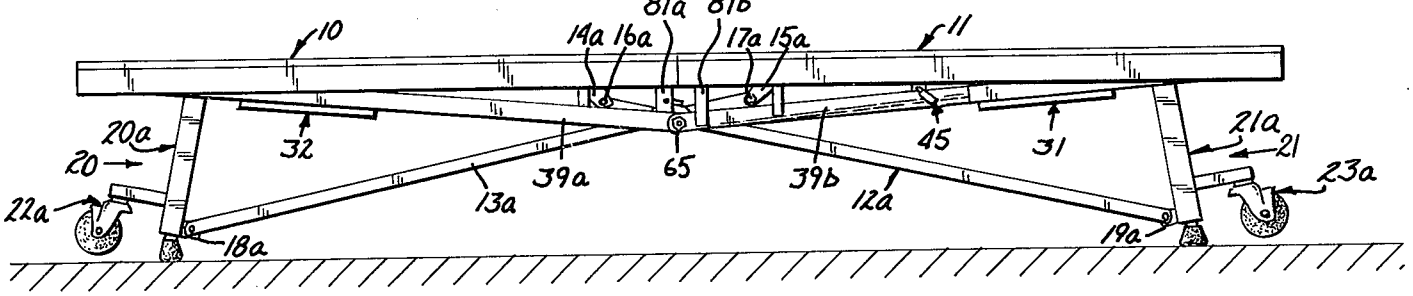
FIG. 1 is a view in side elevation of a foldable stage according to the present invention.
Figure 3:
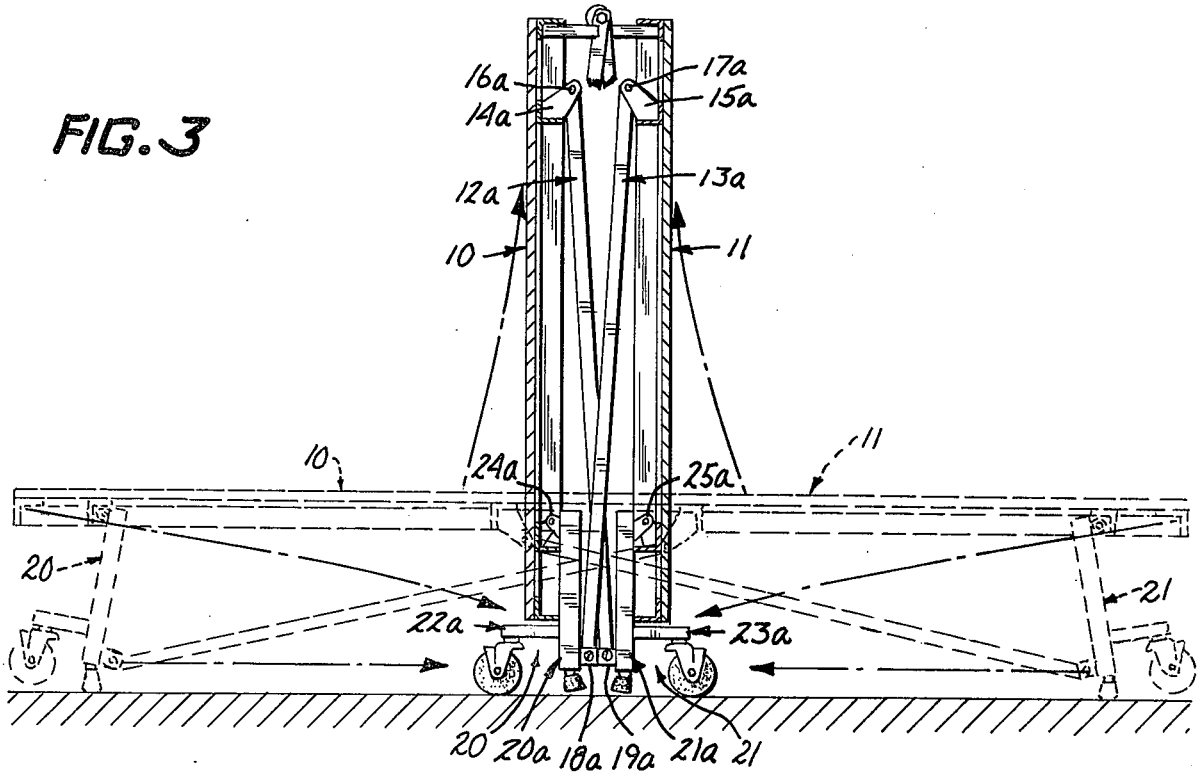
FIG. 3 is a diagramatic view illustrating the folding of the stage of FIG. 1 from a first operational position to a second folded position, with portions of the structure removed for clarity.

First stage member 10 and second stage member 11 are hingeably interconnected to provide for movement of the stage members from a first operational position in which the surfaces of stage members 10 and 11 are generally coplanar, defining the entire surface of the stage by the dotted lines on FIG. 3, to a second upright folded position, as also shown in FIG. 3, in which the surface of the first stage member 10 is generally parallel to the surface of said second stage member 11. The means provided for the hingeable interconnection of first stage member 10 and second stage member 11 includes two pairs of cross brace linkage members, the first pair being **12*a* and 12 *b*, and the second pair being 13*a* and 13*b*, which are oppositely connected to the underside of the first stage member 10 and second stage member 11 respectively. As shown in FIG. 1, the cross brace linkage means 12*a* is pivotally secured to the first stage member 10 by a mounting bracket 14*a*, which forms a part of the underside of the first stage member 10. The cross brace linkage means 12*a* is pivotally connected to the mounting bracket 14*a* by bolt means 16*a*. As shown in FIG. 2, there is actually a pair of cross brace linkage means 12*a* and 12*b*, which are attached to the first stage member 10, one on either side thereof. Cross brace linkage means 12*b* is identical to 12*a* and is attached to an identical mounting bracket 14*b*. The cross brace linkage means 12*a* and 12 *b* are metal brace rods but can be formed of any material of suitable strength. Similarly, there is an identical pair of cross brace linkage means 13*a* and 13*b* which are pivotally attached to the second stage member 11. The opposite pair of cross brace linkage means 13***a* and 13*b* are attached to corresponding mounting brackets 15*a* and 15*b* and are pivotally secured thereto by bolts 17*a* and 17 *b*. It must be noted that each of the cross brace linkage means 12*a*, 12*b*, 13*a*, and 13*b* must be pivotal on each of the respective mounting brackets 14*a*, 14*b*, 15*a*, and 15*b*, since each of the cross braces provide the linkage which permits the hingeable movement of the individual stage members 10 and 11 from the first operational position to the second folded position.

Cross brace linkage means 12*a* is also pivotally attached at its opposite end to a stage support leg 21*a* at leg mounting bracket 19*a*. Cross brace linkage means 12*b* is also pivotally attached at its opposite end to leg mounting bracket 19*b* on stage support leg 21*b*. Similarly, the cross brace linkage means 13*a* and 13*b* are pivotally secured at their opposite ends to mounting brackets 18*a* and 18*b* on stage support legs 20*a* and 20*b*. The length of the individual cross brace linkage means and the positioning of the various stage member mounting brackets is a function of several variables. The length of the individual cross braces is a function of the length of the individual stage members 10 and 11, the length of the stage support leg structures 20 and 21, the positioning of the support leg structures 20 and 21 on the stage members 10 and 11, and the positioning of the various mounting brackets on the two stage members. More simply, the length of the individual cross brace linkage means is determined by the distance from the given stage member mounting bracket to the leg mounting bracket on the corresponding stage support leg. For example, the distance from the pivot bolt means 17 a on stage member mounting bracket 15*a* to the leg mounting bracket 18*a* on stage support leg 20*a* would define the length of the cross brace linkage means 13*a*. Thus, the more critical variable is the positioning of the stage member mounting brackets 14*a*, 14*b*, 15*a*, and 15*b* on the stage members 10 and 11 respectively. Once the length of the overall stage and the length and positioning of the support leg structures are selected, the positioning of the mounting brackets must be ascertained. In this regard, not exact formulation can be applied to determine an optimum position for the stage member mounting brackets, nor in fact must there be an exact determination of positions. If the stage member mounting brackets are placed closer to the middle of each of the stage members the effect would be to increase the distance between the two stage members 10 and 11 in the upright folded position. If the stage member mounting brackets are placed closer to the ends where the stage members 10 and 11 adjoin the effect is to decrease the distance between the stage members in the upright folded position. Hence, placement of the stage member mounting brackets is accomplished by determining a point where the stage members, when in the upright folded position, are not so far apart that the entire stage is unbalanced or too unwieldy for storage or they are not too close together such that the cam support linkages 38*a*, 38*b*, 39*a* and 39*b*, later described in detail, and the two pairs of cross brace linkage means will bind or otherwise prevent smooth operation. Once the proper position of the stage member mounting brackets is determined, the only remaining concern is to make sure the brackets are all placed at identical positions to ensure smooth operation of the cross brace linkage members throughout the movement of the stage from the first operational position to the second folded position.

Figure 8:
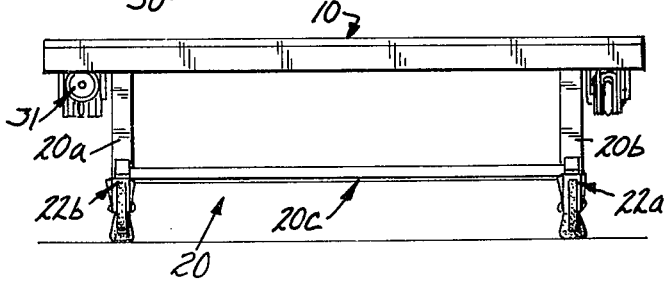
FIG. 8 is an end plan view of the stage of FIG. 1.

The support leg structures, generally 20 and 21 as shown in FIGS. 1–2 are identical, such that each individual stage member, member 10 and member 11 respectively, includes a pair of downwardly extending legs and a transverse support brace therebetween connecting each pair of individual legs. Specifically, in FIG. 8, stage member 10 is shown with the downwardly extending individual legs 20*a* and 20*b* attached thereto and the transverse support brace 20*c* being attached between legs 20*a* and 20*b* near the lower end of the legs. The stage support legs 20*a*, 20*b*, 21*a* , and 21*b* are pivotally secured to each of their respective stage members in a similar manner. For example, in FIG. 6 there is shown stage support leg 20*a* and its pivotal attachment to the first stage member 10. The leg 20*a* is pivotally attached to a stage member mounting bracket 24*a* which forms a part of the underside of the stage member 10. Each of the remaining legs 20*b*, 21*a*, and 21*b* are similarly mounted to the underside of the respective stage members.

The stage support legs also include roller wheels 22*a*, 22*b*, 23*a*, and 23*b* each being mounted respectively on individual legs 20*a*, 20*b*, 21*a*, and 21*b*. the various roller wheels are secured to the appropriate legs by welding at or near the joint of the legs and the transverse support brace.

The individual roller wheels are mounted such that when the stage is in its first operational position and the support leg structures 20 and 21 engage the floor, the roller wheels will be disengaged from the floor. This is accomplished by positioning the support legs at a slight angle to the perpendicular as best shown in FIG. 1.

The cooperation of the various cross brace linkage means and the pivotal legs is such that when the stage is moved from its first operational position to its second folded position, the cross brace linkage means 12*a* and 12*b* will pivot about mounting brackets 14*a* and 14*b* on the first stage member 10 causing the support legs 21*a* and 21*b* on the second stage member 11 to move, generally inwardly. Similarly and concurrently, as the stage is being moved from the first position to the second position, the cross brace linkage means 13*a* and 13*b* will pivot on mounting brackets 15*a* and 15*b* on stage member 11 causing the stage support legs 20*a* and 20*b* on stage member 10 to mve inwardly.

As shown in FIG. 3, the leg members will continue to pivot inwardly on mounting brackets 18*a* and 18*b* and 19*a* and 19*b* while the legs simultaneously pivot on the stage member mounting brackets 24*a* and 24*b*, and 25*a* and 25*b*. as the support leg structures 20 and 21 are moved toward each other approaching the center, each of the four roller wheels will engage the floor to support the structure. In the folded position the support legs 20 and 21, as shown in FIG. 3, will have pivoted back until they no longer extend downward parallel to the plane of each of the respective stage members 10 and 11. The stage members 10 and 11 have moved from the first operational position in which the stage member surfaces are coplanar to a second folded position in which The surfaces of stage member 10 and stage member 11 are generally parallel to each other while being generally vertical to the floor.

In addition to the cross brace linkage means previously discussed, the stage members 10 and 11 are connected together by two pair of support linkages, generally 38 and 39. As best seen in FIG. 2, stage member 10 has a pair of cam support linkages 38*a* and 39*a*. Similarly, stage member 11 has a pair of cam support linkages 38*b* and 39*b*. As seen in FIG. 1, cam support linkage 39*a* is attached to the underside of stage member 10 at its left end, then angled slightly away from stage member 10 to connect thereto at its other end by means of a spacer link 81*a*. In similar manner, cam support linkage 39*b* connects to the underside of stage member 11 by any suitable means at its right hand side, and angles slightly away from the surface at its left end, nearest the other stage member. Link 81*b* connects this end of cam support linkage 39*b* to stage member 11. The adjoining ends of cam support linkages 39*a* and 39 *b* overlap, and are pivotally joined by means of a pivot 65. On the other side of the stage as seen in FIG. 2, cam support linkages 38*a* and 38*b* are connected to their respective stage members in the same manner, and are pivotally connected to each other by pivot 66.

Since the cam support linkages are connected to the stage members and are pivotally connected to each other, as recited above, it is clear that pivot points 65, 66 necessarily define the axis about which stage members 10 and 11 pivot when moving from the operational position to the folded position. Accordingly, the lengths of the cam support linkages 38*a*, 38*b*, 39*a*, and 39*b*, and the lengths of the spacer links 81*a* and 81*b* must be selected so as to place the pivots 65, 66 in a position which is compatible with the geometry of the cross brace linkage means and the legs, as previously described. Since the positioning of the stage member mounting brackets 14*a* and 15*a* for the cross brace linkage means affects the distance between the two stage members in their folded position, it is apparent that the offsetting of pivot points 65, 66 from stage members 10 and 11 by means of spacer links 81*a*, 81*b* must correlate to the distance between the two stage members in their folded position in order to provide smooth operation and avoid any binding of the various linkages.

A counter balance spring system is provided to facilitate movement of the stage between its two positions, by variably biasing the stage members towards their folded positions. A counter balance spring system 30 is connected to the underside of stage member 10 and a similar counter balance spring system 31 is connected to the underside of stage member 11. These springs operate through cables stretched over cams about the pivot points 66 and 65 respectively to provide the bias force. Since the two spring system are identical, but for operating on different sides of the stage assembly, the detailed description will be given only of counter balance spring system 31.

Figure 7:
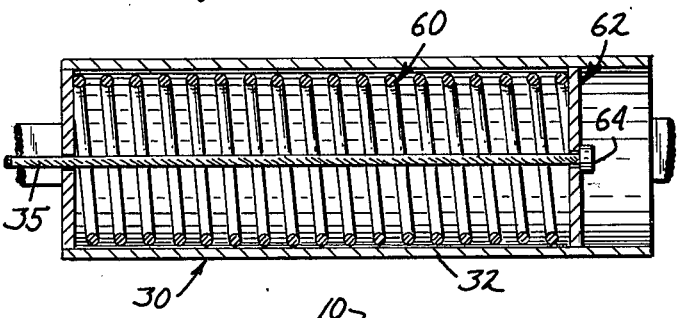
FIG. 7 is an enlarged sectional view of a counter balance spring system used in the present invention.

Spring system 31 includes a spring housing 33 having a bias spring 60 therein, as shown in FIG. 7. A cable 35 extends through bias spring 60 and is attached to the rear thereof by the use of a pressure plate 62 and a keeper lug 64 thereon. Cable 34 extends from the spring housing to where it is wrapped around the surface of a cam 36, as seen for example in FIG. 5. Cam 36 is welded to a backing plate 83 which is larger in circumference than the cam. The backing 83 is welded to cam support linkage 39*a*. Another backing plate similar to 83 would be welded to the other side of cam 36 so as to provide a cable guiding path therebetween. However, this other backing plate has been cut away in the view of FIG. 5 so that the manner in which cable 35 wraps around cam 36 can be more clearly observed. The pivot point 65 which pivotally connects cam support linkages 39 and 38 passes through cam 36 in the position shown. Cable 35 includes a lug stop 48 thereon which engages a cut out portion of cam 36. Lub 48 together with a cotter pin 49 in backing plate 83 adjacent the cam prevent the cable from being disengaged from the cam.

Since cam 36 is welded to cam support linkage 39*a* and hence to stage member 10, but is not welded to its corresponding cam support linkage 39*b*, the effect of tension applied to cable 35 is to bias the cam and support 39*a* to move in a counter-clockwise direction about the pivot point 65. As explained hereinafter, this bias force tends to pivot the stage members to their folded position.

As seen in FIG. 2, in the preferred embodiment, the cam linkage support 39*a* and 39*b* are actually two generally parallel bars being immovably secured to the outer ends, respectively, of stage member 10 and stage member 11. Where cam support linkages 39*a* and 39*b* are joined at pivot 65, cam 36 is positioned between the two parallel bars of the cam support linkages such that the pivot bolt 65 is inserted through alignable holes in the cam support linkage 39*a* and 39*b* and through the cam 36. Cam support linkage 39*b* also serves to secure the spring housing 33 in position on stage member 11. This is accomplished by spot welding the parallel bars of the cam support linkage 39*b* along either side of the spring housing 33. A similar construction is used with respect to the parallel bars which comprise cam support linkage 38*a* and 38*b* on the other side of the stage. As stated previously, the stage of the present invention is elevationally adjustable. This is accomplished by operation of extension legs 40 on stage member 10 and extension legs 41 on stage member 11. Extension legs 40 and 41 are identical. Therefore, specific description will be made with reference to legs 40 only.

Figure 6:
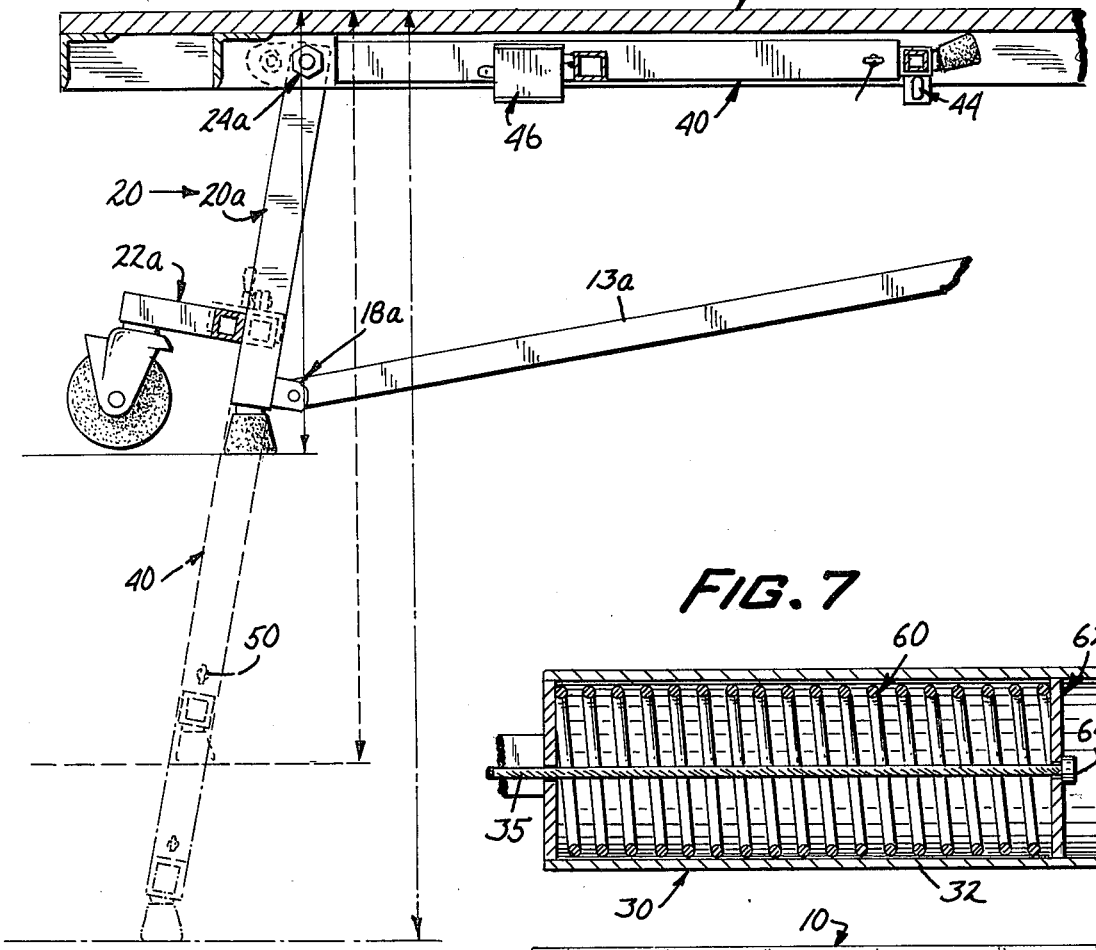
FIG. 6 is a sectional view taken generally along the line 6—6 of FIG. 2 showing two alternate positions of the secondary leg means.

As seen in FIG. 2, extension leg means 40 is comprised of parallel legs 40*a* and 40*b* which are hingeably mounted to the stage member 10, respectively, at hinge mount 42*a* and hinge mount 42*b*. A transverse support member 52 extends between and is connected to individual leg members 40*a* and 40*b*. Extension leg means 40 is pivotal between two positions, a first storage position as indicated in FIG. 2, and a second operational position, as shown generally in FIG. 6, in which extension leg 40 is pivoted downward into alignment with leg means 20. To maintain the extension leg means 40 in its first storage position a spring biased release means 44 is mounted on the underside of the stage member 10 such that it is biased towards engagement with a keeper hole on the lower portion of extension leg 40. To release the extension leg means 40 the handle 70 of the spring biased release means 44 is pulled outwardly against the bias of spring 71, thus disengaging the spring biased release means 44 from the hole in the extension leg member 40. The extension leg member 41 on stage member 11 is similarly released by contraction of its spring biased release means 45. Since extension leg members 40 and 41 are longer then support legs 20 and 21, the stage will be at a higher elevation when the legs 40 and 41 are in the down extended position, as shown in FIG. 6.

A third elevation is achieved by the telescopic effect of the extension legs 40 and 41 of stage members 10 and 11. Referring again to extension leg member 40, the telescopic legs 40*a* and 40*b* are retained in position by leg keepers 50*a* and 50*b* respectively. The inner telescopic portion of leg 40*a* includes two receiver holes therein which correspond to a first retracted position, as shown in FIG. 2, and a second extended position as shown in FIG. 6. The leg keeper means 50*a* and 50*b* are threadably engageable through the inner holes of telescopic leg 40*a* and 40*b*. A lower transverse support member 54 extends between and connects the lower portions of telescopic legs 40*a* and 40*b*.

When the extension leg members 40 and 41 are in the down position, whether telescoped or untelescoped, they are clamped to the support legs 20 and 21 respectively for additional support. This is accomplished by use of the leg clamp means 46 on extension leg member 40 and leg clamp means 47 on extension leg member 41. In the down extended position, the transverse support member 52 of extension leg member 40 is aligned with the transverse support member 20*c* of support leg structure 20. The leg clamp 46 on the transverse support member 52 engages the transverse support member 20 to firmly secure extension leg member 40 to support leg structure 20. Once the extension leg member 40 is firmly secured to the support leg structure 20, the individual legs 40*a* and 40*b* can be telescoped to achieve the third elevation.

It should be noted that before the stage of the present invention can be moved from its first operational position to its second folded position, the extension leg member 40 and 41 must be retracted to its first storage position as indicated in FIG. 2.

Folding of the stage of the present invention from its first operational position in which the surfaces of stage member 10 and stage member 11 are coplanar, to the second folded position in which stage member 10 and stage member 11 are generally parallel to each other requires the cooperation of the various cross brace linkage means, the legs, and the counter balance spring systems.

To move the stage from the first operational position which is indicated by the dotted lines in FIG. 3, to the second folded position indicated in the solid lines in FIG. 3, it is only necessary to apply an upward force to either of stage members 10 or 11 at or near the area where they face each other.

Figure 5:
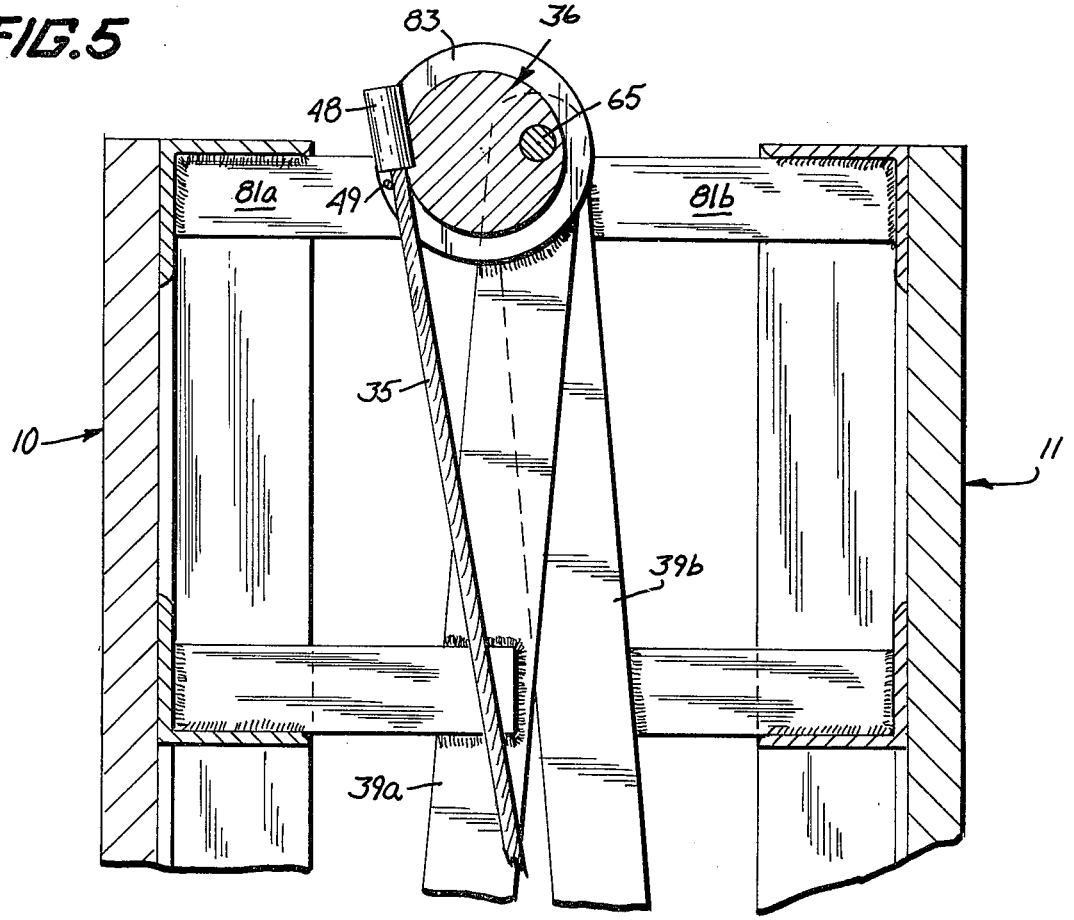
FIG. 5 is a view similar to FIG. 4 showing the stage in its second folded position.

Since the center of gravity of the stage in its folded position is obviously higher than the center of gravity in its operational position, it is apparent that some work must be supplied to the system in folding it up. The counter balance spring system 30 and 31, previously described, supply most of the necessary force for folding the tables, by release of energy previously stored in compression of the springs when the stage was folded down to its operational position. It will be appreciated that the amount of counter balancing force, in the form of a moment applied to cam 36 about pivot 65 in FIG. 5, is not constant but varies as the stage is being moved to its folded position. By carefully selecting the curvature of the surface of cam 36 which is engaged by cable 35 as it wraps therearound, the counter balancing moment applied to the cam can be tailored to match the counter balancing force required. In designing the cam, factors which must be considered are the total weight of the two stage members and connecting linkages, the spring constant of the springs used, the effective radius arm between the cable and cam at a given point, and the amount of compression of the springs at the given point.

Figure 4:
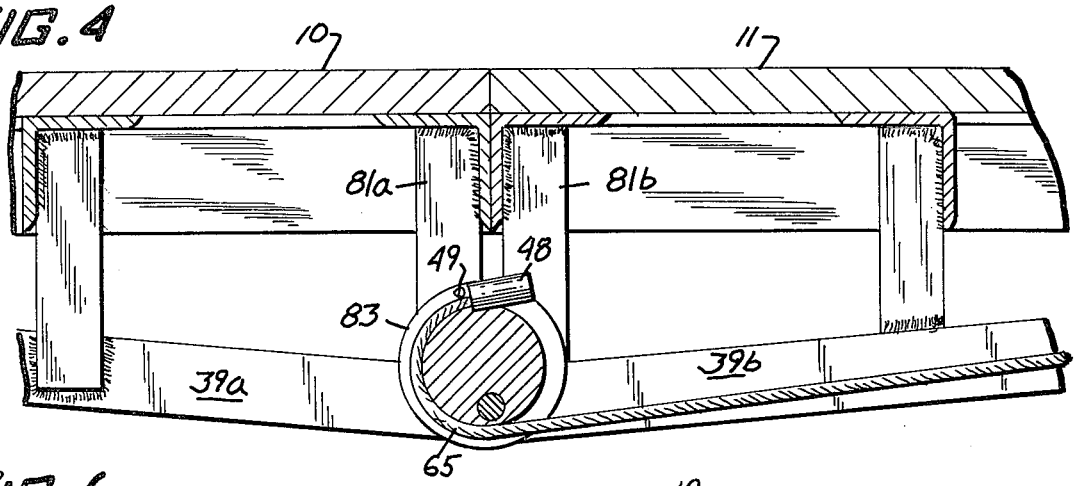
FIG. 4 is a sectional view taken generally along the line 4—4 of FIG. 2, showing the stage in its first operational position.

For example, in FIG. 4, with the stage in its operational position, the counter balancing system 31 applies a moment corresponding to the spring constant times the amount of spring compression, times the effective lever arm of the cam in that position, which is the distance from the center of pivot 65 to the point on the cam surface where cable 35 is tangent to the cam surface. In FIG. 5, the effective lever arm is relatively small, but the degree of spring compression is very great, since the spring has been compressed by an amount equal to the amount of cable 35 actually wrapped around cam 36. When the stage is in its folded position, as indicated in FIG. 5, the effective radius arm of the counter balance spring system is much greater, from the tangent point which is at the point of engagement of cable lug 48. Consequently, however, since the cable has been unwound from the cam surface, most of the compression of the spring has been released, so that the tension applied through cable 35 is correspondingly lower. In designing the cams for the pair of counter balance spring systems, 30, 31 for the stage of the present invention, it should be bore in mind that the counter balance moment actually apply through the cam and cam support braces is a function not only of the effective radius of the cam at a given angular position, but also of the total surface area around which the cable is wrapped at the given angular position. This, of course, is because the degree of compression of the spring depends on the amount of cable pulled and wrapped around the cam surface. It is thus possible by a trial and error or reiterative design process to calculate the required cam radius at each point, together with the total cam surface area around which the cable will wrap up to each point, for a given stage weight and spring constant.

In the preferred embodiment, the cams and counter balance spring systems are designed to give complete counter balancing of the gravity load on the stage for all positions except those when the stage is near its operational position. At this point, the cam is tapered off slightly to provide slightly less than complete counter balance force, so that the stage will be assured of sitting flat, rather than being slightly bowed upwards in case too much counter balance force were applied. To fold the stage, an operator must push upward at the center to overcome the slight deficit in the counter balancing force for a short distance. Once this short distance is overcome, the full counter balancing comes into play with the stage being essentially neutral in all other positions. The operator can then push the stage to its folded position with ease.

Concurrently with the operation of the spring cable and cam and cam linkages the cross brace linkage means on stage member 10 and 11 are pulled towards each other causing the pivotal support leg members 20 and 21 to trail along. Further, as the support leg structures 20 and 21 follow the cross brace linkage members, they simultaneously pivot about the upper hinge mounts 24 and 25 on stage member 10 and stage member 11 respectively, until the stage is completely in the upright folded position and stage member 10 is generally parallel to stage member 11. The support legs 20 and 21 are generally parallel to each of the respective stage members 10 and 11, and support leg 20 and support leg 21 are both slightly elevated above the ground with the corresponding roller wheels 22 and 23 engaging the floor. In this condition, the stage can easily be transported for storage until later use.

It is readily apparent that various changes and modifications of the illustrative embodiments herein can be made without departing from the scope of the appended claims.

We claim:

1. An elevationally adjustable mobile folding stage, comprising:

a. a first stage member being generally rectangular which is hingeably connected to a generally rectangular second stage member such that said first stage member and said second stage member are adjustable between an operational horizontal position in which the surfaces of said first and second stage members are generally coplanar and a second upright folded position in which the surfaces of said first and second stage members are generally parallel to each other;

b. a first pair of legs pivotally secured to the underside of said first stage member which are adjustable between two positions in response to movement of said first and second stage members between said horizontal operational position and said upright folded position such that when said first and second stage members are in said horizontal position said first pair of legs are in a first operational position which is generally perpendicular to the plane of said first stage member and when said stage members are in said upright folded position said first pair of legs are in a second position which is generally parallel to the plane of said first stage member, said legs including:

1. a generally horizontal support brace which extends between and is connected to each of said legs, and 2. a wheel means on each of said legs mounted such that when said legs are in said first position said wheel means are elevated above the legs and when said legs are in said second position said wheels are in contact with the floor to provide for and facilitate mobility of said folding stage;

c. a first pair of extension legs being longer than said first pair of legs on said first stage member hingeably mounted to the underside of said first stage member at one end of said legs and releasably engageable with said first stage member at the opposite end of said first pair of extension legs such that said first pair of extension legs are pivotal between a first storage position in which said extension legs are retained in a position generally parallel to the planar surface of said first stage member and a second operational position in which said extension legs are disengaged from said first stage member and extend downwardly from said first stage member generally perpendicularly;

d. means on said first stage member for releasably engaging said first pair of extension legs in said first storage position;

e. a second pair of legs pivotally secured to the underside of said second stage member which are adjustable between two positions in response to the adjustment of said first and second stage members between said horizontal and said folded position such that when said stage members are in said horizontal positions said legs are in a first operationl position which is generally perpendicular to the plane of said second stage member and when said stage members are in the upright folded position said legs are in a second position which is generally parallel to the plane of said second stage member, said legs including:

1. a generally horizontal support brace which extends between and is connected to each of said legs; and 2. a wheel means on each of said legs mounted such that when said legs are in said first position said wheel means are elevated above said legs and when said legs are in said second position said wheel means are in contact with the floor to provide for and facilitate mobility of said folding stage;

f. a second pair of extension legs, being longer than said second pair of legs on said second stage member, hingeably mounted to the underside of said second stage member at one end of said legs and releasably engageable with said second stage member at the opposite end of said second pair of extension legs such that said extension legs are pivotal between a first storage position in which said extension legs are retained in a position generally parallel to the planar surface of said second stage member and a second operational position in which said second pair of extension legs are disengaged from said second stage member and extend downwardly from said second stage member generally perpendicularly;

g. means on said second stage member for releasably engaging said second pair of extension legs in said first storage position;

h. a first counterbalance spring system mounted on the underside of said first stage member, said system including:

1. a spring means and housing therefor mounted along the underside of said first stage member;

2. a cable attached to one end of said spring means, said cable including a stop means thereon to retain said cable on said spring;

3. a first cam support linkage means being connected to said first stage member and said housing, said cam support linkage means extending across the underside of said first stage member and being pivotally connected to a second cam support linkage means near the juncture of said first and second stage members, said second cam support linkage means extending across said second stage member and being connected to the remote end of said second stage member, and 4. a cam means engageable with said cable, said cam means being positioned between and connected to said first cam support linkage means and said second cam support linkage means where said first and second cam support linkage means are joined;

i. a second counterbalance spring system mounted on the underside of said second stage member, said system including:

1. a spring means and housing therefor mounted along the underside of said second stage member;

2. a cable attached to one end of said spring means, said cable including a stop means thereon to retain said cable on said spring;

3. a first cam support linkage means being connected to said second stage member and said housing, said cam support linkage means extending across the underside of said second stage member and being pivotally connected to a second cam support linkage means near the juncture of said first and second stage members, said second cam support linkage means extending across said first stage member and being connected to remote end of said first stage member, and 4. a cam means engageable with said cable, said cam means being positioned between and connected to said first cam support linkage means and said second cam support linkage means where said first and second cam support linkage means are joined;

j. a first pair of extension legs, being longer than said first pair of legs on said first stage member, hingeably mounted to the underside of said first stage member at one end of said legs and releasably engageable with siad first stage member at the opposite end of said first pair of extension legs such that said extension legs are pivotal between a first storage position in which said extension legs are retained in a position generally parallel to the planar surface of said first stage member and a second operational position in which said first pair of extension legs are disengaged from said first stage member and extend downwardly from said first stage member generally perpendicularly;

k. means on said first stage member for releasably engaging said first pair of extension legs in said first storage position;

l. a second pair of extension legs, being longer than said second pair of legs on said second stage member, hingeably mounted to the underside of said second stage member at one end of said legs and releasably engageable with said second stage member at the opposite end of said second pair of extension legs such that said extension legs are pivotal between a first storage position in which said extension legs are retained in a position generally parallel to the planar surface of said second stage member and a second operational position in which said second pair of extension legs are disengaged from said second stage member and extend downwardly from said second stage member generally perpendicularly; and m. means on said second stage member for releasably engaging said second pair of extension legs in said first storage position.

* * * * *